United States Patent [19]

Mehrotra et al.

[11] Patent Number: 4,568,454

[45] Date of Patent: Feb. 4, 1986

[54] BENEFICIATION OF HIGH CARBONATE PHOSPHATE ROCK

[75] Inventors: Vikram P. Mehrotra; Kallidaikurichi N. Sivaramakrishnan, both of Terre Haute, Ind.

[73] Assignee: International Minerals & Chemical Corp., Terre Haute, Ind.

[21] Appl. No.: 642,468

[22] Filed: Aug. 20, 1984

[51] Int. Cl.[4] ..... B03D 1/02

[52] U.S. Cl. ..... 209/167

[58] Field of Search ..... 209/166, 167

[56] References Cited

U.S. PATENT DOCUMENTS

| | | | |
|---|---|---|---|
| 4,189,103 | 2/1980 | Lawver et al. . | |
| 4,287,053 | 9/1981 | Lehr et al. | 209/167 |
| 4,317,715 | 3/1982 | Hintikka et al. | 209/166 |
| 4,364,824 | 12/1982 | Snow | 209/167 |
| 4,372,843 | 2/1983 | Lawver et al. . | |
| 4,425,229 | 1/1984 | Baron et al. | 209/167 |
| 4,460,460 | 7/1984 | Cariello et al. | 209/167 |
| 4,486,301 | 12/1984 | Itsieh et al. | 209/166 |

OTHER PUBLICATIONS

Biswas—Role of $CO_2$ in Flotation of Carbonate Minerals—Indian Journal of Technology, vol. 5, 6/67, pp. 187–189.

Shah—Investigation of Use of High Molecular Wt. Amines for Separation by Froth Flotation—Lowell Univ.

*Primary Examiner*—Bernard Nozick

*Attorney, Agent, or Firm*—Howard E. Post

[57] ABSTRACT

The amount of carbonate mineral impurities is reduced in aqueous phosphate rock slurry by (a) conditioning the slurry with an effective amount of $CO_2$, (b) adding an effective amount of an anionic collector to the slurry and (c) subjecting the slurry to a froth flotation process whereby the carbonate mineral impurities are concentrated in the froth. The $CO_2$ acts to depress flotation of phosphate minerals relative to the carbonate mineral impurities.

21 Claims, No Drawings

BENEFICIATION OF HIGH CARBONATE PHOSPHATE ROCK

BACKGROUND OF INVENTION

The present invention relates to a method of reducing carbonate mineral impurities in aqueous phosphate rock slurries. In a particular aspect, the present invention relates to the use of a conditioning agent which selectively inhibits the flotation of phosphate rock with respect to carbonate mineral impurities. The selective inhibition of the phosphate rock allows the carbonate mineral impurities to be concentrated in the froth.

The "Crago" or "double float" froth flotation process, as described by A. Crago in U.S. Pat. No. 2,293,640, Aug. 18, 1942, is commercially used for beneficiating fractions of phosphate ores in which siliceous minerals are the predominant gangue. That process consists of conditioning the material with fatty acid reagents, flotation of the phosphate mineral, deoiling of the concentrate with sulfuric acid to remove the reagents, and refloating with amine reagents to remove the siliceous gangue which either floated or is trapped in the rougher fatty acid flotation.

Some phosphate ores contain carbonate gangue materials in addition to siliceous minerals. The alkaline earth metal carbonate minerals are common impurities in certain ore deposits. Examples of these deposits are the South Florida deposits and the Western Phosphates found in Idaho, Montana, Utah and Wyoming. Such mineral impurities include calcite ($CaCO_3$), dolomite ($CaCO_3$. $MgCO_3$), seashells, aragonite, dolomitic limestone and other less common minerals. The "double float" process has generally been ineffective for removing carbonate mineral impurities from phosphate ore because the flotation characteristics of the carbonate minerals are very similar to those of the mineral phosphates.

Phosphate ores containing undesirable amounts of carbonate mineral impurities greater than 1% by weight must be treated to reduce carbonate mineral impurities to levels below 1% by weight. Carbonate mineral impurities >1% cause problems when the phosphate rock is used for making wet process phosphoric acid. These problems include high acid consumption during the process for preparing wet process phosphoric acid and, an increase in the viscosity of the reaction mixture and the precipitation of sludge forming compounds. The latter two problems are more severe when the carbonate mineral is in the form of magnesium carbonates such as dolomite.

Known methods of reducing the carbonate mineral impurities involve flotation processes wherein a phosphate depressant is added to an aqueous slurry of phosphate rock prior to flotation. Known phosphate depressants include HF, sodium tripolyphosphate, sodium hexametaphosphate, sodium pyrophosphate, fluosilicic acid and orthophosphoric acid.

Problems associated with the above phosphate depressants include high costs and contamination of the water supply preventing reuse of the water in other flotation processes. The present invention remedies the above problems by providing a cheap and contamination-free phosphate rock depressant.

SUMMARY OF INVENTION

Briefly, in accordance with the present invention, the concentrations of carbonate mineral impurities in an aqueous phosphate rock slurry are reduced to acceptable levels by conditioning the aqueous phosphate rock slurry with an effective amount of $CO_2$ prior to subjecting the aqueous phosphate rock slurry to a froth flotation process employing an anionic collector. The present method is carried out by conditioning or pretreating aqueous phosphate rock slurry which has high levels (>1%) of carbonate mineral impurities with an effective amount of carbon dioxide ($CO_2$) usually by bubbling or injecting gaseous $CO_2$ into the slurry. After the slurry is conditioned with $CO_2$, an effective amount of an anionic collector is added to the slurry. The slurry is then subjected to a froth flotation process using air or $CO_2$ as the carrier gas whereby the carbonate mineral impurities are concentrated in the froth while the phosphate rock is left behind as the cell underflow. The phosphate-rich cell underflow which contains low levels of carbonate mineral impurities is dried and sent to concentrated phosphate stockpiles. The concentrated phosphate stockpiles are then chemically treated to produce wet process phosphoric acid employing standard procedures. Alternatively, the concentrated phosphate stockpiles can be sold as is.

Of particular interest in the practice of the present invention is a method for reducing the concentration of dolomite impurities present in phosphate ores, especially phosphate concentrates from the "double float" process.

DETAILED DESCRIPTION OF THE INVENTION

The term "carbonate mineral impurity" when used herein, is meant to encompass alkaline earth metal carbonate minerals and in particular calcite ($CaCO_3$), dolomite ($CaCO_3.MgCO_3$), seashells, aragonite, dolomitic limestone and other less common minerals.

The term "BPL", when used herein, stands for bone phosphate of lime or $Ca_3(PO_4)_2$ which is a standard indicator of phosphate content in fertilizers.

In the practice of the present invention, it is essential to employ: an aqueous phosphate rock slurry containing carbonate mineral impurites, $CO_2$, and an anionic collector.

The phosphate ores containing carbonate mineral impurities are mined from the earth by conventional methods. The phosphate ores of particular interest are found in sedimentary deposits in south and central Florida. After mining the phosphate ore from the earth, the ore is beneficiated employing standard well-known techniques such as those described in U.S. Pat. Nos. 2,293,640 (see particularly Col. 3, line 59 to line 72); 4,364,824 (see particularly Col. 3, line 61 through Col. 6, line 37); 4,372,843 (see particularly Col. 4, line 53 through Col. 7, line 27); and 4,189,103 (see particularly Col. 6, line 29 through Col. 7, line 34), all of which are incorporated herein by reference. Advantageously, the phosphate ore treated according to the present invention is a concentrated slurry from the standard "double float" flotation process. Advantageously, the weight percent of solids in the concentrated slurry is from about 50 to about 80% and preferably from about 65 to about 75%.

The use of $CO_2$ to pretreat or condition the carbonate containing phosphate ore slurry is the second critical aspect of the present invention and gaseous $CO_2$ is preferably employed. $CO_2$ or any agent that is capable of generating $CO_2$ in situ can be used in practicing the present invention. $CO_2$ is added to the aqueous phosphate ore slurry in an amount effective to inhibit the flotation of phosphate rock. In a preferred embodiment of the present invention, $CO_2$ is added to the aqueous phosphate rock slurry in an amount sufficient to saturate the aqueous slurry. When $CO_2$ is added in this amount, i.e., point of saturation, the pH of the slurry falls to between about 4 to about 6 and usually to about 5. Excess $CO_2$, if any, may be vented or recycled.

The third essential component for practicing the present invention is an anionic collector. Suitable anionic collectors include fatty acids or salts thereof, sulfonated fatty acids or salts thereof and soaps. Preferred anionic collectors include soaps tall oil and sodium oleate. One or more anionic collectors are added to the aqueous phosphate rock slurry in an amount ranging from about 0.1 to about 5 pounds per tone (about 0.5 to about 2.5 g/kg) of phosphate rock present in the slurry, advantageously from about one-half to about two pounds per ton (about 0.25 to about 1 g/kg) of phosphate rock and preferably from about one to about two pounds per ton (about 0.5 to about 1g/kg) of phosphate rock.

Once the aqueous phosphate rock slurry is conditioned with $CO_2$ and an anionic collector as described above, other chemical conditioning reagents such as collector extenders and frothers can be added to the aqueous slurry prior to the flotation process. Suitable collector extenders include kerosene, fuel oil, mineral oil, mineral spirits or mixtures thereof, and typical frothers include pine oil, alcohol, methyl isobutyl carbinol (MIBC) or other well known frothing agents.

The amount of collector extender varies with the type of ore and anionic collector used. Generally the weight to weight ratio of extender to anionic collector varies from about 0.5:1 to about 6:1. The exact amount of extender to be used in a particular operation is readily determined by one skilled in the art. Likewise, the amount of frother, if required at all, is readily determined by one skilled in the art. Typically, frothers are employed in amounts ranging from a few parts per million up to bout 0.2 lb/ton (about 0.1 g/kg) of solids. Conditioning parameters, such as time, temperature and weight percent solids all fall in the ranges currently employed for the conventional "double float" flotation process.

After the aqueous phosphate rock slurry is conditioned with $CO_2$, an anionic collector(s) and other flotation conditioning reagents, with conditioned feed is diluted with water so that the solids content is from about 10 to about 30 percent by weight. This diluted aqueous phosphate rock slurry is subjected to a froth flotation process using air or $CO_2$ as the carrier gas employing standard procedures wellknown to one skilled in the art. Preferably, the solids content of the aqueous phosphate rock slurry during the flotation process is from about 15 to about 25 percent by weight. The froth flotation process is conducted in any of the standard flotation vessels or cells used in the industry. The residence time in the flotation cell or vessel is determined by the particular ore characteristics at hand and the amount of carbonate mineral impurities tolerable in the final concentrate. One skilled in the art can readily determine these parameters. Upon conducting the present flotation process, the carbonate mineral impurities are concentrated in the froth which is physically separated from the aqueous slurry. The cell underflow contains phosphate rock having a low concentration of carbonate mineral impurities when compared to the original aqueous phosphate rock slurry.

In one embodiment of the present invention, a concentrate from the "double float" flotation process is made into a slurry containing from about 65 to about 75% solids. $CO_2$ gas is then bubbled or injected into the slurry in an amount sufficient to saturate the slurry, after which the pH of the slurry is between about 4 and about 6. A fatty acid anionic collector is added to the slurry in an amount from about one to about two pounds of collector per ton of phosphate rock in the slurry. Optionally, other conditioning agents such as frothers and collector extenders are added to the slurry. Following the above conditioning, the aqueous phosphate rock slurry is diluted with water to 15–25% solids and subjected to a froth flotation process in a flotation cell using air as the carrier gas. The froth, which is collected, is concentrated in carbonate mineral impurities relative to the amounts of such impurities present in the aqueous phosphate rock slurry after the froth flotation.

In a preferred embodiment of the present invention, a phosphate ore concentrate from the "double float" flotation process is made into an aqueous phosphate rock slurry containing from about 65 to about 75% by weight solids wherein the phosphate rock is derived from sedimentary deposits of phosphate ores in south or central Florida containing apatite as the phosphate component and further containing greater than one percent of dolomite. This aqueous phosphate rock slurry is conditioned by injecting gaseous $CO_2$ into the slurry until the slurry is $CO_2$ saturated, after which the pH of the slurry is between 4 and 6. After the $CO_2$ conditioning step, the slurry is transferred to another vessel for conditioning with tall oil. Tall oil is added to the slurry, with agitation, in an amount ranging from about one-half to about two pounds per ton (about 0.25 to about 1 g/kg) of phosphate rock in the slurry. Optionally, collector extenders, frothing agents or other chemical froth flotation reagents are added to the aqueous phosphate rock slurry. The aqueous phosphate rock slurry is diluted with water to about 15–25% solids and subjected to a froth flotation process in any of the standard flotation cells using air as the carrier gas. The dolomite impurity is concentrated in the froth which is separated from the slurry while the aqueous phosphate slurry in the cell underflow constitutes the desired product which contains apatite as the phosphate-rich ore with lower concentrations of dolomite when compared to the original phosphate slurry feed.

In further embodiments, the $CO_2$ conditioning agent of the present invention can be advantageously employed in combination with one or more phosphate depressants. Such phosphate depressants include HF, sodium tripolyphosphate, sodium pyrophosphate, fluosilicic acid and orthophosphoric acid.

The following examples illustrate the practice of the present invention, but should not be construed as limiting its scope.

EXAMPLE 1

A synthetic mix of 90 parts by weight apatite and 10 parts by weight dolomite was mixed with deionized water to form a slurry containing 20 percent by weight solids. The pH of the slurry was adjusted to 8 by the addition of nitric acid and/or ammonium hydroxide. An equilibration period of one hour was allowed before carrying out the flotation test. During this equilibration period, the pH of the slurry was checked every half hour and adjusted to 8 by the addition of nitric acid or ammonium hydroxide. After the one hour equilibration period, samples of the slurry were placed in 250 gram (g) Denver flotation cells. Each sample was 1250 g. $CO_2$ gas was bubbled through two samples of the slurry for thirty seconds at a flow rate of four liters/minutes. Sodium oleate was added to each sample at different dosages equivalent to 0.5 and 1 pound per ton of solids (lb/ton) in the slurry, directly followed by the addition of two (2) drops of MIBC frother. These samples were allowed a thirty second conditioning period before the start of the flotation process which was continued for five minutes using air as the carrier gas. The feed concentrate and tail fractions were collected, dried, weighed and chemically analyzed to calculate BPL recovery and the concentrate grade. The results are listed below in Table 1.

TABLE 1

Flotation of Synthetic Apatite-Dolomite Mixture $CO_2$ Conditioning Time: 30 Sec. Flotation Time: 5 Min.
Initial pH: 8.0 Final pH: 5.0

| Sodium Oleate Lb/Ton | Feed Assay % BPL | Feed Assay % MgO | Feed Assay % Insol* | Product Assay % BPL | Product Assay % MgO | Product Assay % Insol | % BPL Recovery |
|---|---|---|---|---|---|---|---|
| 0.5 | 63.9 | 2.16 | 4.2 | 66.2 | 1.69 | 3.5 | 97.0 |
| 1.0 | 63.9 | 2.03 | 4.4 | 67.1 | 1.52 | 3.1 | 91.1 |

*"% Insol" represents other insoluble impurities such as sand, clay and other mineral oxides.

EXAMPLE 2

Substantially the same procedures described in Example 1 were repeated except that an actual sample of phosphate ore mined in Kingsford mine, Polk County, central Florida, and beneficiated by the "double float" process was used instead of a synthetic mix of apatite/-dolomite. The ore sample had a relatively high dolomite impurity concentration which is expressed as "% MgO" in Table 2. The results are listed in Table 2 below.

TABLE 2

Flotation of High Dolomite Kingsford Ore $CO_2$ Conditioning Time: 30 Sec. Initial pH: 8
Flotation Time: 5 Min. Final pH: 4.9 (Run #1-3)
Final pH: 4.8 (Run #4-6)

| Run | Sodium Oleate Lb/Ton | Feed Assay % BPL | Feed Assay % MgO | Feed Assay % Insol* | Product Assay % BPL | Product Assay % MgO | Product Assay % Insol | % BPL Recovery |
|---|---|---|---|---|---|---|---|---|
| 1 | 0.5 | 66.4 | 1.18 | 4.6 | 69.2 | 0.61 | 4.22 | 98.9 |
| 2 | 1.0 | 66.6 | 1.12 | 4.5 | 70.3 | 0.43 | 3.93 | 91.7 |
| 3 | 2.0 | 66.8 | 1.15 | 4.4 | 70.6 | 0.41 | 4.04 | 73.2 |
| 4 | 0.5 | 63.9 | 1.49 | 4.8 | 66.1 | 0.94 | 4.80 | 99.6 |
| 5 | 1.0 | 62.2 | 1.32 | 4.9 | 68.8 | 0.53 | 4.90 | 97.6 |
| 6 | 2.0 | 63.6 | 1.49 | 4.8 | 67.9 | 0.53 | 4.30 | 77.8 |

*"% Insol" represents other insoluble impurities such as sand, clay and other mineral oxides.

EXAMPLE 3

Substantially the same procedures described in Example 1 were repeated except that an actual sample of phosphate ore mined in Hardee County, south Florida, and beneficiated by Gardinier Company using the "double float" process (Gardinier concentrate) was used instead of a synthetic mix of apatite/dolomite. The ore sample had a relatively high dolomite impurity concentration (expressed in "% MgO" in Table 3) with a particularly high unliberated dolomite content. The results are listed in Table 3 below.

TABLE 3

Flotation of High Dolomite Gardinier Concentrate $CO_2$ Conditioning Time: 30 Sec. Final pH: 4.7
Flotation Time: 5 Min.
Initial pH: 8.0

| Sodium Oleate Lb/Ton | Feed Assay % BPL | Feed Assay % MgO | Feed Assay % Insol | Product Assay % BPL | Product Assay % MgO | Product Assay % Insol | % BPL Recovery |
|---|---|---|---|---|---|---|---|
| 0.5 | 59.2 | 1.20 | 9.5 | 59.8 | 1.08 | 9.5 | 99.1 |
| 1.0 | 59.3 | 1.21 | 9.4 | 59.8 | 1.08 | 9.4 | 99.1 |
| 2.0 | 59.3 | 1.19 | 9.3 | 60.0 | 1.08 | 9.4 | 99.0 |

In other embodiments of the present invention employing the various phosphate rocks, anionic collectors, carrier gases and other conditioning agents, all described herein, the concentration of the various carbonate mineral impurities present in phosphate rock is reduced.

We claim:

1. A method of reducing the concentration of carbonate mineral impurities in an aqueous phosphate rock slurry containing such impurities which comprises:

(a) conditioning the aqueous phosphate rock slurry with $CO_2$ in an amount effective to preferentially inhibit the flotation of the phosphate rock with respect to the carbonate mineral impurities and to provide a pH between about 4 to 6;

(b) adding to the conditioned aqueous phosphate rock slurry an effective amount of an anionic collector to form a flotation feed;

(c) subjecting the flotation feed to froth flotation to cause the carbonate mineral impurites to be concentrated in the froth; and (d) removing phosphate rock having a reduced concentration of carbonate mineral impurities from the flotation underflow as the tails product.

2. The method of claim 1 wherein the phosphate rock present in the aqueous phosphate rock slurry is sedimentary phosphate rock.

3. The method of claim 2 wherein the phosphate-rich component of the phosphate rock is an apatite mineral.

4. The method of claim 1 wherein the major carbonate mineral impurity is dolomite.

5. The method of claim 4 wherein the aqueous phosphate rock slurry is conditioned with gaseous $CO_2$ in a quantity sufficient to saturate the slurry.

6. The method of claim 4 wherein the phosphate rock present in the aqueous phosphate rock slurry is sedimentary phosphate rock.

7. The method of claim 6 wherein the phosphate-rich component of the phosphate rock is an apatite mineral.

8. The method of claim 7 wherein the anionic collector is a fatty acid or a salt thereof, a sulfonated fatty acid or a salt thereof, tall oil, sodium oleate or mixtures thereof.

9. The method of claim 8 wherein the anionic collector is added to the aqueous phosphate rock slurry in an amount ranging from about 0.1 to about 5 pounds per ton of solids present in the slurry and the $CO_2$ is added to the aqueous phosphate slurry in an amount sufficient to saturate the slurry with $CO_2$.

10. The method of claim 9 wherein the anionic collector is tall oil.

11. The method of claim 10 wherein the tall oil is added to the aqueous phosphate rock slurry in an amount ranging from about 0.5 to about 2 pounds per ton of solids present in the slurry.

12. The method of claim 11 wherein (i) the aqueous phosphate rock slurry in step (a) contains from about 50 to about 80 percent solids by weight; and (ii) the froth flotation of step (c) is carried out by (I) further conditioning the flotation feed with a collector extender, a frother or both;

(II) diluting the flotation feed with water to bring the solids content to about 15 to about 25 percent by weight;

(III) introducing a froth-inducing amount of a carrier gas into the diluted flotation feed to produce a froth; and (IV) separating the froth from the diluted flotation feed whereby the dolomite is concentrated in the froth.

13. The method of claim 12 wherein the carrier gas is air or $CO_2$.

14. The method of claim 1 wherein the anionic collector is a fatty acid collector or a salt thereof.

15. The method of claim 14 wherein the fatty acid collector or salt thereof is added to the slurry in an amount ranging from about 0.5 to about 5 pounds per ton of solids.

16. The method of claim 1 wherein the anionic collector is a soap.

17. The method of claim 16 wherein the soap is added to the slurry in an amount ranging from about 0.5 to about 5 pounds per ton of solids.

18. The method of claim 1 wherein the anionic collector is tall oil.

19. The method of claim 18 wherein the tall oil is added to the slurry in an amount ranging from about 0.5 to about 5 pounds per ton of solids.

20. The method of claim 1 wherein the anionic collector is sodium oleate.

21. The method of claim 20 wherein the sodium oleate is added to the slurry in an amount ranging from about 0.5 to about 5 pounds per ton of solids.

* * * * *

UNITED STATES PATENT AND TRADEMARK OFFICE

CERTIFICATE OF CORRECTION

PATENT NO. : 4,568,454

DATED : February 4, 1986

INVENTOR(S) : V. P. Mehrotra and K. N. Sivaramakrishnan

It is certified that error appears in the above-identified patent and that said Letters Patent are hereby corrected as shown below:

Column 3, line 17, "tone" should read --ton--.

Column 3, line 41, "bout" should read --about--.

Column 3, line 49, "with" should read --the--.

Column 5, line 7, "liters/minutes" should read --liters/minute--.

Signed and Sealed this

*Thirteenth* Day of *May 1986*

[SEAL]

*Attest:*

*Attesting Officer*

DONALD J. QUIGG

*Commissioner of Patents and Trademarks*